US006705216B2

(12) United States Patent
Conrad

(10) Patent No.: US 6,705,216 B2
(45) Date of Patent: Mar. 16, 2004

(54) CALENDER

(75) Inventor: Hans-Rolf Conrad, Dormagen (DE)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 10/158,112

(22) Filed: May 31, 2002

(65) Prior Publication Data

US 2003/0024413 A1 Feb. 6, 2003

(30) Foreign Application Priority Data

Jun. 16, 2001 (DE) ..... 101 29 102

(51) Int. Cl.[7] ..... B30B 3/04

(52) U.S. Cl. ..... 100/158 R; 100/163 R; 100/169

(58) Field of Search ..... 100/155 R, 162 R, 100/163 R, 176, 161, 163 A, 167, 168, 173, 158 R, 169

(56) References Cited

U.S. PATENT DOCUMENTS 3,918,775 A * 11/1975 Lehmann ..... 384/546
6,402,889 B1 * 6/2002 Gwosdz-Kaupmann et al. . 162/193
2002/0134255 A1 * 9/2002 Svenka et al. ..... 100/163 A

FOREIGN PATENT DOCUMENTS

| | | | |
|---|---|---|---|
| AT | 232840 B | * | 4/1964 |
| DE | 19856517 | | 6/2000 |
| DE | 20013667 U1 | * | 10/2000 |
| DE | 19944089 | | 11/2000 |
| DE | 10028179 | | 12/2001 |
| EP | 1026316 A2 | * | 8/2000 |
| EP | 1092805 | | 4/2001 |
| EP | 1 162 308 A1 | * | 6/2001 |
| NL | 135 506 C | * | 6/1972 |

* cited by examiner

*Primary Examiner*—Allen Ostrager
*Assistant Examiner*—Jimmy T Nguyen
(74) *Attorney, Agent, or Firm*—Greenblum & Bernstein, P.L.C.

(57) ABSTRACT

Calender including at least one roll stack having a plurality of rolls arranged to form at least one nip, a stand arrangement having a stand located at each axial end of the at least one roll stack, and antifriction bearings arranged to support the plurality of rolls on the stand arrangement. Each stand includes a bearing edge on which the antifriction bearings are arranged, a contact edge structured and arranged to contact a mounting surface, and a connecting edge forming a connection between the bearing edge and the contact edge. Each stand further includes a plate structured and arranged to include the bearing edge, the contact edge and the connecting edge to one another.

21 Claims, 2 Drawing Sheets

CALENDER

CROSS-REFERENCE TO RELATED APPLICATIONS

The present application claims priority under 35 U.S.C. §119 of German Patent Application No. 101 29 102.7, filed on Jun. 16, 2001, the disclosure of which is expressly incorporated by reference herein in its entirety.

BACKGROUND OF THE INVENTION

1. Field of the Invention

The present invention relates to a calender with at least one roll stack having a maximum of three rolls arranged to form at least one nip limited by two rolls, and with a stand arrangement featuring a stand at each axial end of the roll stack. The rolls are supported on the stand with the aid of antifriction bearings.

Such a calender, which is also called a "soft calender," is used mainly in paper production. Since it features only one or two nips per roll stack, it is particularly suitable as a machine calender which can be used in-line, i.e., directly following a paper machine.

2. Discussion of Background Information

A known calender of the type mentioned at the outset features an essentially perpendicular (vertical) standing roll stack with two rolls, with both rolls being arranged in an L-shaped stand. This embodiment has the advantage that both rolls can be dismantled and installed with the aid of a crane, thus also the lower roll.

However, it has been shown that the L-stand is not suitable for higher operating speeds and larger widths. Experience shows that there is a risk of vibration problems at speeds of over about 1200 m/min and widths of over about 7 m.

In order to take higher speeds into account, a U-shaped stand has been used in which there are stand columns both on the front and on the back of the roll stack. This stand construction is not open at the front or at the back of the roll stack, so that dismantling the bottom roll is possible only by extending the bottom roll out via the face, i.e., axially. Since this procedure requires that an assembly space be kept free next to the calender, i.e., an assembly space that corresponds at least to the length of the roll, considerable space is required.

SUMMARY OF THE INVENTION

The present invention provides a soft calender which can be operated at a high speed and with which a roll change is easily possible.

According to the instant invention, the stand of the calender of the type mentioned at the outset includes a bearing edge on which the antifriction bearings are arranged and which is tilted at an angle to a vertical reference in a range of about 30° to 60°, a contact edge on which the stand stands on a mounting surface and which extends beneath the bearing edge, and a connecting edge forming a connection between the bearing edge and the contact edge. Further, the bearing edge, the contact edge and the connecting edge are connected by a plate.

The instant invention contemplates a roll stack tilted at an angle, i.e., inclined to the vertical. A preferred angle of tilt is about 45° which, however, can be changed within the scope of the values given above. As a result of the instant structural arrangement, a partial load alleviation, i.e., the specific weight of the upper roll no longer acts on the line load in the nip to the full extent. However, there is still a vertical roll weight component that leads to a minimum load on the antifriction bearings, so that its play does not lead to increased vibration behavior of the rolls. Due to the tilt, the rolls of the roll stack can again be handled by a crane, i.e., to be dismantled and/or installed. Despite these easy possibilities for changing a roll, a high operating speed and a large working width are rendered possible by the special construction of the stands. The stands have a very wide bearing surface that is the result of the contact edge supporting the bearing edge over its entire length. This support is implemented by a plate so that no hinge points or other connection points are formed between the contact edge and the bearing edge that could be distorted in a critical way. Thus, the plate provides the stand with an extraordinarily high degree of rigidity. Although the stand extends further in the flat (horizontal) direction due to the tilt of the bearing edge relative to the vertical, the total height is reduced.

The plate can include openings as needed for assembly or maintenance purposes. However, as a whole, it may be preferable that the plate be formed as an essentially flat form which accordingly provides a high mechanical stability. The rolls can be supported in a leverless manner, i.e., they can either be displaced parallel to the bearing surface or they can be rolls with jacket lift.

The plate preferably includes a thickness of at least about 150 mm, and more preferably of at least about 200 mm. The choice of a relatively "thick" plate has several advantages: high mechanical stability results, and a sufficiently large area is available in the bearing edge to provide mounting openings for the antifriction bearings or to other attachment parts. A stand embodied or formed in this way is considerably more rigid than previously known stands, which utilized columns and tie-bars to form a box-frame construction, i.e., by welding together in box form comparatively thin metal sheets with a thickness in the range of about 20 mm.

The plate is preferably formed by a sheet metal that essentially includes a triangular shape. The term "sheet metal" is intended to also cover metal plates with the above-mentioned thickness range according to the invention. Such a triangle is easy to produce, since only a few cuts are necessary to determine the triangular shape. Furthermore, it results in a pleasing appearance.

Here it is particularly preferred for the triangle to feature capped points, so as to keep the required construction space small, while also saving other material. In this regard, it is assumed that the points of a triangle do not contribute much to the stability of the stand, but instead represent a risk of forming oscillatory parts.

The triangle is preferably embodied or formed, e.g., as a right-angled triangle, in which the hypotenuse forms the bearing edge. In this manner, the construction space required for the stand can be kept as small as possible. Further, the contact edge is shorter than the bearing edge. In the illustrated embodiment, the connecting edge is vertically oriented so that it can be used as an orientation surface or edge for attachment parts requiring a vertical orientation.

Two roll stacks are preferably provided, and each stack includes a plate-like stand with an essentially triangular shape with connecting edges substantially vertically oriented at each axial end. Moreover, the two roll stacks may preferably be positioned adjacent to one another. This arrangement of two roll stacks is known per se, and makes it possible for the material web to first rest with its first side on a hard roll and with its opposite second side on a soft roll, i.e., a roll with an elastic or resilient surface, while in the next roll stack the conditions are exactly reversed, i.e. the second side rests on the soft roll and the first side on the hard roll. Of course, it is also possible to use only rolls with the same type of surface in each roll stack. If the connecting edges are substantially vertically oriented and the stands placed mirror-inverted or mirror-symmetrical to each other, the stands can be positioned with a relatively small distance between them, thereby keeping the required construction space small.

The present invention is directed to a calender including at least one roll stack having a plurality of rolls arranged to form at least one nip, a stand arrangement having a stand located at each axial end of the at least one roll stack, and antifriction bearings arranged to support the plurality of rolls on the stand arrangement. Each stand includes a bearing edge on which the antifriction bearings are arranged, a contact edge structured and arranged to contact a mounting surface, and a connecting edge forming a connection between the bearing edge and the contact edge. Each stand further includes a plate structured and arranged to include the bearing edge, the contact edge and the connecting edge to one another.

In accordance with a feature of the instant invention, the bearing edge can be tilted at an angle between about 30° to 60° from a vertical reference, and the bearing edge can be arranged to extend under an entire extent of the bearing edge.

According to another feature of the invention, the plurality of rolls may include a maximum of three rolls. Further, the plurality of rolls can include two rolls.

The plate can have a thickness of at least about 150 mm, and preferably has a thickness of at least about 200 mm.

Moreover, the plate can be composed of a metal sheet. The metal sheet may be formed in a triangular shape, and the bearing edge can be oriented at an angle between about 30° and 60° with respect to a vertical reference. The triangular shape may have at least one truncated point. Further, the triangular shape can include an right-angled triangle, and the hypotenuse of the right-angled triangle may form the bearing edge. Still further, the right-angled triangle may include an isoscolese right-angled triangle.

The plate can be formed in a triangular shape, and the bearing edge may be oriented at an angle between about 30° and 60° with respect to a vertical reference, and the triangular shape can include a right-angled triangle, and the hypotenuse of the right-angled triangle can be arranged to form the bearing edge.

In accordance with a further feature of the invention, the plate can be composed of a right-angled triangular metal sheet arranged such that the hypotenuse of the right-angled triangular element forms the bearing edge.

Each the plate can be formed with a thickness sufficient stand on the contact edge and to support the plurality of rolls without additional support elements.

Further, the at least one roll stack can include two roll stacks and each roll stack may be is supported on a separate stand arrangement. Each the plate of each stand arrangement may be triangularly shaped and the connecting edges of each stand arrangement can be substantially vertically oriented and positioned adjacent the connecting edges of the other stand arrangement. Each roll stack may include a hard roll and a soft roll, and the roll stacks can be arranged such that a hard roll will contact each surface of the web and a soft roll will contact each surface of the web.

In accordance with a still further feature of the invention, attachment parts for guiding the web may be coupled to the plate.

The present invention is directed to a calender including at least one roll stack having a plurality of rolls arranged to form at least one nip, a stand arrangement including stands located at each axial end of the at least one roll stack, and antifriction bearings arranged to support the plurality of rolls on the stand arrangement. The stands include a plate formed with a bearing edge on which the antifriction bearings are arranged, a contact edge structured and arranged to contact a mounting surface, and a connecting edge forming a connection between the bearing edge and the contact edge.

According to a feature of the instant invention, the plate may include a triangular metal sheet arranged as a right-angled triangle such that the bearing edge can be oriented at an angle between about 30° and 60° from a vertical reference.

The present invention is directed to a calender including at least two roll stacks, in which each roll stack includes a plurality of rolls arranged to form at least one nip, a stand arrangement for each roll stack, in which each stand arrangement includes a stand located at each axial end of each roll stack, and antifriction bearings arranged to support the plurality of rolls on each the stand arrangement. Each stand includes a plate structured and arranged to form a bearing edge on which the antifriction bearings are arranged, a contact edge structured and arranged to contact a mounting surface, and a connecting edge forming a connection between the bearing edge and the contact edge.

In accordance with yet another feature of the present invention, the plate may include a triangular metal sheet arranged as a right-angled triangle such that the bearing edge can be oriented at an angle between about 30° and 60° from a vertical reference. The stand arrangements may be positioned adjacent each other and the connecting edges of each stand arrangement can be substantially vertically oriented, and the connecting edges of opposing stand arrangements may be positioned to face each other.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
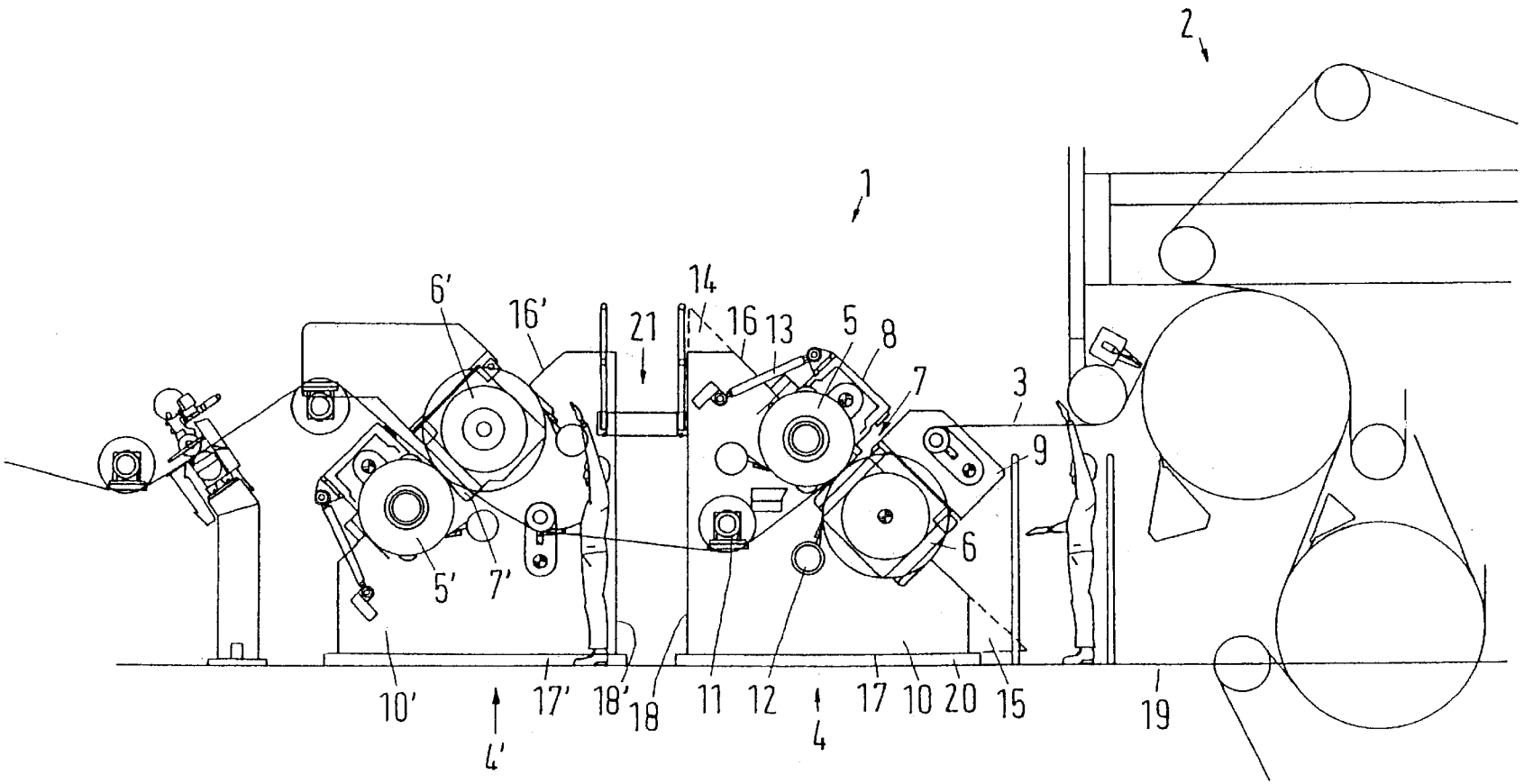
FIG. 1 illustrates a calender in accordance with the features of the invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

A calender 1 is arranged at an outlet of a paper machine 2 (shown only in diagrammatic form) to glaze a web 3 coming out of paper machine 2.

To this end, calender 1 includes a first roll stack 4 with a hard roll 5 and a soft roll 6. The hard roll 5 is made of metal and features a hard, but very smooth surface. Soft roll 6 includes an elastic coating, so that the surface of soft roll 6 is elastic, and hard roll 5 and soft roll 6 are arranged to form a nip to process web 3. In the exemplary example, the nip is sometimes referred to as a "soft" nip. However, it is noted that the invention is not limited to a formed by a hard and a soft roll, and that the nip can also be formed by two rolls of similar type and/or construction. Rolls 5 and 6 are rotatably supported in antifriction bearings 8 and 9. Antifriction bearings 8 and 9 are fixed in a stand 10. It is to be understood that a corresponding stand 10 is positioned at both axial ends of rolls 5 and 6. Further, various attachment parts, e.g., a deflection roll 11, doctor blades 12 or a variable speed drive 13, can be installed on stand 10. The listing of these various elements is provided for illustration and example and should not in any way be considered as limiting.

Stand 10 is essentially formed of a right-angled, equal-sided (isoscolese) triangle, with points 14 and 15 of the triangular shape being capped (truncated) at sharp angles. For ease of discussion, points 14 and 15 are depicted in dotted lines.

The hypotenuse of the triangularly shaped element forms a bearing edge 16, while a lower cathetus (leg) forms a contact edge 17 and the other cathetus (leg) forms a connecting edge 18. Contact edge 17 is arranged to stands on floor 19 or; if necessary, on an interlayer of a base plate 20, which is placed on floor 19.

Figure 2:
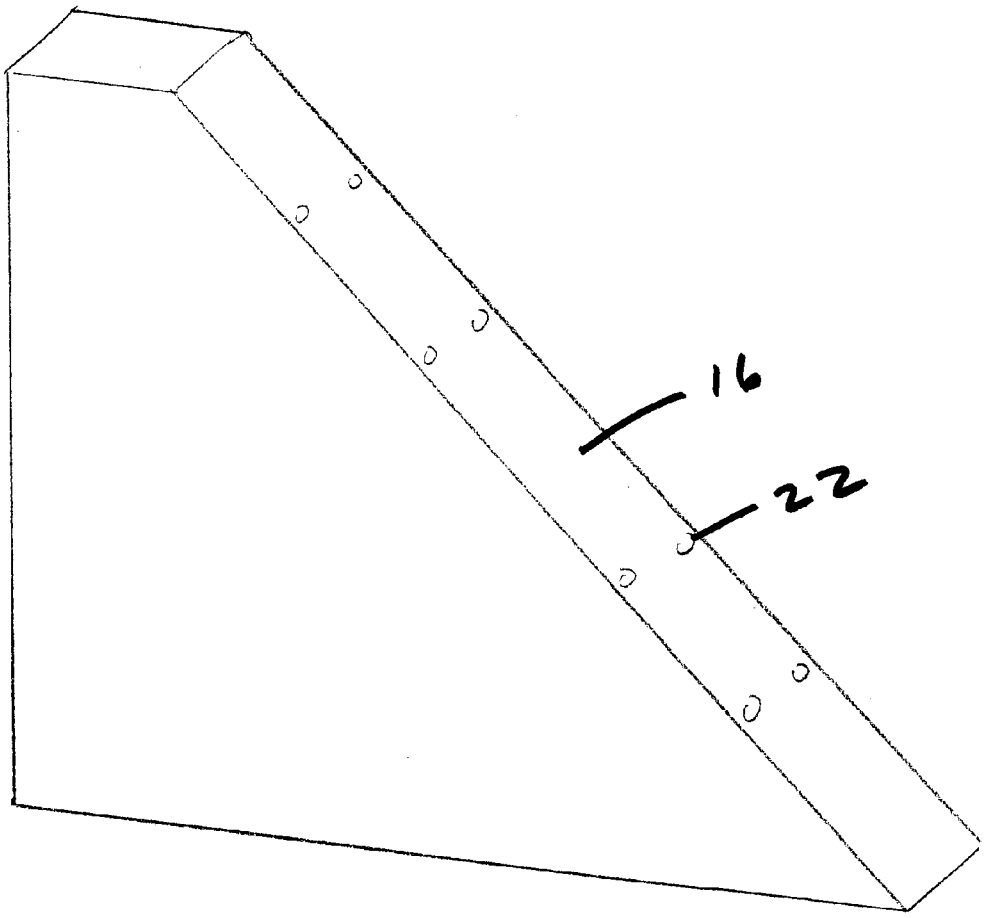
FIG. 2 illustrates the bearing edge of the triangular shaped plate.

Stand 10 is formed by a metal sheet having a thickness of about 200 mm or more. Accordingly, surfaces of a corresponding width result at the individual edges 16–18 of the triangularly shaped element. Thus, stand 10 can stand by itself in a stable manner on contact edge 17 without any further measures. An assembly surface then exists on bearing edge 16, on which antifriction bearings 8 and 9 can be attached. To this end, it is possible, e.g., to make tapholes (or mounting openings) 22 in the surface on bearing edge 16 (see FIG. 2).

In the exemplary embodiment, it is shown that the triangle is not only right-angled but also equal-sided (isosceles). However, this is not a requirement of the invention, and is shown as such merely for ease of description and discussion. For example, in lieu of the depicted orientation of the tilt of the roll stack of about 45° to vertical, a tilt in the range of about 30° to 60° is also possible. However, it is advantageous if contact edge 17 is positioned to support bearing edge 16 over its entire length, as shown. Further, it is noted that the relatively high rigidity of stand 10 results from individual edges 16–18 being connected by the plate of stand 10.

Also illustrated in the exemplary embodiment, calender 1 includes a second roll stack 4' is arranged on stand 10' and oriented in a mirror-symmetrical manner to stand 10. For ease of explanation, corresponding parts of each stand are provided with same reference numerals additionally marked with a prime sign (').

Roll stack 4' includes soft roll 6' in the upper position and hard roll 5' in the lower position. In this manner, each side (upper and lower) of web 3 is conducted past one of hard rolls 5 and 5', as well as past one of soft rolls 6 and 6', such that both sides of web 3 are similarly processed in calender 1, e.g., in the first nip, the hard roll contacts the upper surface and the soft roll contacts the lower surface and, in the second nip, the soft roll contacts the upper surface and the hard roll contacts the lower surface. Accordingly once with its upper side and once with its lower side, while it is next conducted past the soft roll 6 with its under side and then past the soft roll 6' with its upper side.

The two connecting edges 18 and 18' stand substantially vertically (or perpendicular) with respect to the floor 19 and/or base plate 20, and they are arranged adjacent to one another, so that, overall, a relatively small construction space is adequate. An accessible platform 21 is arranged between stands 10 and 10', which can be constructed as a vertically adjustable platform, if necessary. This platform can be used, e.g., for maintenance purposes.

Roll stacks 4 and 4' can also include three rolls instead of the two rolls shown in the exemplary illustration.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A calender comprising:

at least one roll stack comprising a plurality of rolls, that include at least a soft roll and a hard roll arranged to form at least one nip;

a stand arrangement comprising a stand located at each axial end of said at least one roll stack;

antifriction bearings arranged to support said hard roll on said stand arrangement; and each said stand is composed of a plate comprising a bearing edge to which said antifriction bearings are attached, a contact edge structured and arranged to contact a mounting surface, and a connecting edge forming a connection between said bearing edge and said contact edge, wherein said plurality of rolls comprises a maximum of three rolls, and wherein said plate has a thickness of at least about 150 mm and is composed of a metal sheet formed in a triangular shape, and said bearing edge is oriented at an angle between about 30° and 60° with respect to a vertical reference.

2. The calender in accordance with claim 1, wherein said bearing edge is arranged to extend from said contact edge to said connecting edge.

3. The calender in accordance with claim 1, wherein said plurality of rolls comprises two rolls.

4. The calender in accordance with claim 1, wherein said plate has a thickness of at least about 200 mm.

5. The calender in accordance with claim 1, wherein said triangular shape has at least one truncated point.

6. The calender in accordance with claim 5, wherein said triangular shape comprises an right-angled triangle.

7. The calender in accordance with claim 6, wherein the hypotenuse of said right-angled triangle forms said bearing edge.

8. The calender in accordance with claim 7, wherein said right-angled triangle comprises an isosceles right-angled triangle.

9. The calender in accordance with claim 1, wherein said triangular shape comprises a right-angled triangle.

10. The calender in accordance with claim 9, wherein the hypotenuse of said right-angled triangle is arranged to form said bearing edge.

11. The calender in accordance with claim 1, wherein said plate is composed of a right-angled triangular metal sheet arranged such that the hypotenuse of said right-angled triangular element forms said bearing edge.

12. The calender in accordance with claim 1, wherein each said plate is formed with a thickness sufficient stand on said contact edge and to support said plurality of rolls without additional support elements.

13. The calender in accordance with claim 1, further comprising attachment parts for guiding the web being coupled to said plate.

14. A calender comprising:

at least one roll stack comprising a plurality of rolls, that include at least a soft roll and a hard roll arranged to form at least one nip;

a stand arrangement comprising a stand located at each axial end of said at least one roll stack;

antifriction bearings arranged to support said hard roll on said stand arrangement; and each said stand is composed of a plate comprising a bearing edge to which said antifriction bearings are attached, a contact edge structured and arranged to contact a mounting surface, and a connecting edge forming a connection between said bearing edge and said contact edge, wherein said at least one roll stack comprises two roll stacks and each roll stack is supported on a separate stand arrangement, wherein each said plate of each stand arrangement is triangularly shaped and said connecting edges of each stand arrangement are substantially vertically oriented and positioned adjacent said connecting edges of the other stand arrangement.

15. The calender in accordance with claim 14, wherein each roll stack comprises a hard roll and a soft roll, and said roll stacks are arranged such that a hard roll will contact each surface of the web and a soft roll will contact each surface of the web.

16. A calender comprising:

at least one roll stack comprising a plurality of rolls arranged to form at least one nip;

a stand arrangement comprising stands located at each axial end of said at least one roll stack;

antifriction bearings arranged to support at least one of said plurality of rolls which is a hard roll on said stand arrangement; and said stands comprising a plate formed with a bearing edge to which said antifriction bearings are attached, a contact edge structured and arranged to contact a mounting surface, and a connecting edge forming a connection between said bearing edge and said contact edge, wherein said plurality of rolls comprises a maximum of three rolls, and wherein said plate has a thickness of at least about 150 mm and is composed of a metal sheet formed in a triangular shape, and said bearing edge is oriented at an angle between about 30° and 60° with respect to a vertical reference.

17. The calender in accordance with claim 16, wherein said triangular shaped metal sheet is arranged as a right-angled triangle.

18. A calender comprising:

at least two roll stacks, each roll stack comprising a plurality of rolls, which includes at least one hard roll, arranged to form at least one nip;

a stand arrangement for each roll stack, each stand arrangement comprising a stand located at each axial end of each roll stack;

antifriction bearings arranged to support said hard roll on each said stand arrangement; and each said stand comprising a plate structured and arranged to form a bearing edge to which said antifriction bearings are attached, a contact edge structured and arranged to contact a mounting surface, and a connecting edge forming a connection between said bearing edge and said contact edge.

19. The calender in accordance with claim 18, wherein said plate comprises a triangular metal sheet arranged as a right-angled triangle such that said bearing edge is oriented at an angle between about 30° and 60° from a vertical reference.

20. A calender comprising:

at least two roll stacks, each roll stack comprising a plurality of rolls, which includes at least one hard roll, arranged to form at least one nip;

a stand arrangement for each roll stack, each stand arrangement comprising a stand located at each axial end of each roll stack;

antifriction bearings arranged to support said hard roll on each said stand arrangement; and each said stand comprising a plate structured and arranged to form a bearing edge to which said antifriction bearings are attached, a contact edge structured and arranged to contact a mounting surface, and a connecting edge forming a connection between said bearing edge and said contact edge, wherein said plate comprises a triangular metal sheet arranged as a right-angled triangle such that said bearing edge is oriented at an angle between about 30° and 60° from a vertical reference, wherein said stand arrangements are positioned adjacent each other and said connecting edges of each stand arrangement are substantially vertically oriented, and wherein said connecting edges of opposing stand arrangements are positioned to face each other.

21. A calender comprising:

at least one roll stack comprising a plurality of rolls arranged to form at least one nip;

a stand arrangement comprising stands located at each axial end of said at least one roll stack;

antifriction bearings arranged to support at least one of said plurality of rolls on said stand arrangement;

each said stand is composed of a triangular shaped plate having a thickness greater than 150 mm, which is formed with a bearing edge on which said antifriction bearings are arranged, a contact edge structured and arranged to contact a mounting surface, and a connecting edge forming a connection between said bearing edge and said contact edge; and said bearing edge being formed on an angled side of the triangular shaped plate to be oriented obliquely to the floor and comprising mounting openings structured and arranged to receive said antifriction bearings.

* * * * *